US008225490B2

(12) United States Patent
Shibata et al.

(10) Patent No.: US 8,225,490 B2
(45) Date of Patent: Jul. 24, 2012

(54) DISASSEMBLED TRANSPORTATION TRANSFORMER TRANSPORTING/ASSEMBLING METHOD

(75) Inventors: Keigo Shibata, Kanagawa (JP); Masaki Sugihara, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 242 days.

(21) Appl. No.: 12/717,624

(22) Filed: Mar. 4, 2010

(65) Prior Publication Data

US 2010/0154202 A1 Jun. 24, 2010

Related U.S. Application Data

(63) Continuation-in-part of application No. PCT/JP2008/002360, filed on Aug. 29, 2008.

(30) Foreign Application Priority Data

Sep. 6, 2007 (JP) ..... 2007-231010

(51) Int. Cl.
*H01F 7/06* (2006.01)

(52) U.S. Cl. ..... 29/605; 29/592.1; 29/602.1; 29/606; 336/200; 336/234

(58) Field of Classification Search ..... 29/592.1, 29/602.1, 604–606; 336/200, 234
See application file for complete search history.

(56) References Cited

FOREIGN PATENT DOCUMENTS

| | | | |
|---|---|---|---|
| JP | 44-9224 | | 4/1969 |
| JP | 47-23848 | | 10/1972 |
| JP | 59-16118 | | 1/1984 |
| JP | 60-182115 | | 9/1985 |
| JP | 04186808 A | * | 7/1992 |
| JP | 10-199740 | | 7/1998 |
| JP | 2001-257119 | | 9/2001 |
| JP | 2003-86429 | | 3/2003 |
| JP | 2004-111855 | | 4/2004 |
| JP | 2007-67112 | | 3/2007 |

* cited by examiner

*Primary Examiner* — Paul D Kim
(74) *Attorney, Agent, or Firm* — Oblon, Spivak, McClelland, Maier & Neustadt, L.L.P.

(57) ABSTRACT

A transformer transporting/assembling method comprises a transportation step of transporting a U-shaped iron core with an iron plate horizontally extending to a place near an installation site and an erection step of erecting the U-shaped iron core together with an erection tank from a state that the iron plate extends horizontally to a state that the iron plate extend vertically, with the U-shaped iron core contained in the erection tank. The erection step includes a sub-step in which a portal lifter composed of two booms which are vertically expandable and parallel movable with a predetermined distance therebetween and between which the erection tank is disposed and a beam horizontally connecting the two booms and vertically moved as the booms expands or contracts is used, the beam supports the erection tank through a flexible member at predetermined support portions, and the beam is vertically moved by expanding/contracting the booms.

8 Claims, 18 Drawing Sheets

DISASSEMBLED TRANSPORTATION TRANSFORMER TRANSPORTING/ASSEMBLING METHOD

CROSS REFERENCES TO RELATED APPLICATIONS

This application is a continuation-in-part (CIP) application based upon the International Application PCT/JP2008/002360, the International Filing Date of which is Aug. 29, 2008, the entire content of which is incorporated herein by reference, and claims the benefit of priority from the prior Japanese Patent Application No. 2007-231010, filed in the Japanese Patent Office on Sep. 6, 2007, the entire content of which is incorporated herein by references.

BACKGROUND OF THE INVENTION

The present invention relates to a transformer transporting/assembling method in a transformer transported in a disassembled condition and a U-shaped iron core assembling device.

In recent years, voltage to be supplied to a transmission system increases with an increase in electric power demand. Accordingly, the capacity, size, and weight of static induction electric appliances, such as transformers, used for power transmission/transformation increase.

Transformer stations in which a transformer is installed are often located in sites with severe transport conditions, such as mountainous area or underground of urban areas. Therefore, it is necessary to significantly reduce the transportation dimension and weight of the static induction electric appliance installed in such sites.

In such a case, a disassembled transportation method capable of significantly reducing the transportation scale and weight of a product to be transported has been adopted as a transportation method of the transformer. In this method, a large capacity three-phase transformer, etc. that has already been produced and tested in a factory is disassembled into several components: a U-shaped iron core, yokes, coils, and the like, then the components are housed in transportation tanks specially designed for the respective components to their installation site, and the respective components are reassembled in, e.g., a clean house built at the installation site. A transformer transported using the above disassembled transportation method is referred to as "disassembled transportation transformer". Recently, the U-shaped iron core is disassembled further into smaller parts (e.g., leg iron core and lower-yoke iron core) in order to reduce the size of components to be transported.

Conventionally, as disclosed in Patent Japanese Patent Application Laid-Open Publication No. 2004-111855, the entire content of which is incorporated herein by reference, the U-shaped iron core or U-shaped iron core that has been divided into a leg iron core and lower-yoke iron core is carried in a spare room where dehumidification and dust removal have been accomplished, taken out of a transporting tank, etc., and carried in an assembling room such as a clean house where dehumidification and dust removal have been accomplished using a heavy device, etc. In the assembling room, the U-shaped iron core and U-shaped iron core tank housing the U-shaped iron core are assembled.

The tank housing the U-shaped iron core is carried out from the assembling room by a heavy machine, etc. and temporarily installed outside the assembling room. After that, at least two heavy machines are used to hoist up/down the U-shaped iron core tank using a wire, etc. while controlling the attitude of the U-shaped iron core tank so as to erect the tank.

However, there exist the following problems in the above example.

For example, an iron core of a large capacity three-phase five-leg transformer is constituted by four U-shaped iron cores. Thus, it is necessary to assemble the four U-shaped iron cores at the installation site after the assembling room of the clean house has been built up. In general, it takes about 7 days to complete the assembly of one U-shaped iron core. In the space of a conventional assembling room where the U-shaped iron core is assembled, it is possible to assemble at most two U-shaped iron cores simultaneously, in general. In this case, it takes about 14 to 17 days to complete the assembly of all the U-shaped iron cores. Thus, it takes more time to install the entire transformer than in the case of a general disassembled transportation transformer where the iron core is transported in the form of the U-shaped iron core by the time length required for assembling the U-shaped iron core at the installation site.

Further, the above work schedule is applicable to only a case where the weather is stable. For example, it is necessary to open the roof of the assembling room when the iron core is carried in the assembling room, so that the carry-in work cannot be performed in the case of rain, delaying the installation.

Further, carry-in of the leg iron core and the yoke iron core and carry-out of an erection tank in which the U-shaped iron core is housed and erected need to be performed using a tow truck. Hoisting up/down of the iron core by a tow truck needs to be performed in both the assembling room and the spare room. The tow truck is parked in the intermediate portion between the assembling room and the spare room and, there, the hoisting up/down of the leg iron core and yoke iron core is performed in a state where the arm of the tow truck is extended in an inclined manner. Thus, a tow truck with large hoisting capacity is required. The rental fee, etc., of such a tow truck with large hoisting capacity is high, and there is no other way but to rent a tow truck whose per-unit time rental fee is high in order to assemble the U-shaped iron core, causing increase in cost.

Further, at least two heavy devices, etc. are required in order to erect the U-shaped iron core or the tank housing the U-shaped iron core. More concretely, at least one 200 ton-class heavy device and one 100 ton-class heavy device are required, requiring a large installation space and a high rental fee, which increases cost.

BRIEF SUMMARY OF THE INVENTION

The present invention has been made to solve the above problems, and an object thereof is to reduce the installation space, installation period, and installation cost in a transformer transporting/assembling method.

In order to achieve the object described above, there is presented a disassembled transportation transformer transporting/assembling method in which a transformer including a U-shaped iron core formed by laminating iron plates is disassembled for transportation and reassembled after the transportation near an installation site of the transformer, the method comprising: a transporting step of transporting the U-shaped iron core in a sideways attitude where the iron plates extend horizontally to a vicinity of the installation site; an erecting step of erecting, after the transporting step, the U-shaped iron core together with an erection tank in a sideways attitude from a state where the iron plates extend horizontally to a state where the iron plates extends vertically to make a bottom plate of the erection tank be positioned at a bottom in a state where the U-shaped iron core is housed in the erection tank, wherein the transporting step including a step of: housing a first leg iron core, a second leg iron core, and a lower-yoke iron core which are obtained by disassembling the U-shaped iron core respectively in a first leg iron core tank, a second leg iron core tank, and a lower-yoke iron core tank each of which has an opening/closing opening portion; closing the opening portions; and transporting the first leg iron core, the second leg iron core, and the lower-yoke iron core individually in a sideways attitude, wherein the erecting step includes a step in which: a portal lifter composed of two booms, which are vertically extensible and parallel movable with a predetermined distance therebetween and between which the erection tank is disposed, and a beam horizontally connecting the two booms and vertically moved as the booms extend or contract is used; the beam supports the erection tank through a flexible member at predetermined support portions; and the beam is vertically moved by extending/contracting the booms; after the transporting step and before the erecting step, a lower-yoke iron core transferring step of transferring the lower-yoke iron core to a lower-yoke iron core assembling tank having an opening portion; a tank connecting step of opening the opening portions of the first leg iron core tank and the second leg iron core tank while maintaining the first leg iron core, the second leg iron core, and the lower-yoke iron core in a sideways attitude and connecting the opening portions of the first leg iron core tank, the second leg iron core tank, and the lower-yoke iron core assembling tank; an iron core connecting step of transferring, after the tank connecting step, the lower-yoke iron core to the insides of the first leg iron core tank and the second leg iron core tank and connecting the first and second leg iron cores and lower-yoke iron core; a lower-yoke iron core assembling tank separating step of separating, after the iron core connecting step, the lower-yoke iron core assembling tank from the first leg iron core tank and the second leg iron core tank while maintaining the connecting state between the first leg iron core tank and the second leg iron core tank; and an erection tank forming step of closing, after the lower-yoke iron core assembling tank separating step, the opening portions of the first and second leg iron core tanks generated by the separation of the lower-yoke iron core assembling tank therefrom by fitting a bottom plate thereto to form the erection tank.

There is also presented a disassembled transportation transformer transporting/assembling method in which a transformer including a U-shaped iron core formed by laminating iron plates is disassembled for transportation and reassembled after the transportation near an installation site of the transformer, the method comprising: a transporting step of transporting the U-shaped iron core in a sideways attitude where the iron plates extend horizontally to a vicinity of the installation site; an erecting step of erecting, after the transporting step, the U-shaped iron core together with an erection tank in a sideways attitude from a state where the iron plates extend horizontally to a state where the iron plates extends vertically to make a bottom plate of the erection tank be positioned at the bottom in a state where the U-shaped iron core is housed in the erection tank, wherein the transporting step including a step of: housing a first leg iron core, a second leg iron core, and a lower-yoke iron core which are obtained by disassembling the U-shaped iron core respectively in a first leg iron core tank, a second leg iron core tank, and a lower-yoke iron core tank each of which has an opening/closing opening portion; closing the opening portions; and transporting the first leg iron core, the second leg iron core, and the lower-yoke iron core individually in a sideways attitude, wherein the erecting step includes a step in which: a portal lifter composed of two booms, which are vertically extensible and parallel movable with a predetermined distance therebetween and between which the erection tank is disposed, and a beam horizontally connecting the two booms and vertically moved as the booms extend or contract is used; the beam supports the erection tank through a flexible member at predetermined support portions; and the beam is vertically moved by extending/contracting the booms; after the transporting step and before the erecting step, a tank connecting step of opening the opening portions of the first leg iron core tank, the second leg iron core tank, and the lower-yoke iron core tank while maintaining the first leg iron core, the second leg iron core, and the lower-yoke iron core in a sideways attitude and connecting the opening portions of the first leg iron core tank, the second leg iron core tank, and the lower-yoke iron core tank; an iron core connecting step of transferring, after the tank connecting step, the lower-yoke iron core to the insides of the first leg iron core tank and the second leg iron core tank and connecting the first and second leg iron cores and lower-yoke iron core; a lower-yoke iron core tank separating step of separating, after the iron core connecting step, the lower-yoke iron core tank from the first leg iron core tank and the second leg iron core tank while maintaining the connecting state between the first leg iron core tank and the second leg iron core tank; and an erection tank forming step of closing, after the lower-yoke iron core tank separating step, the opening portions of the first and second leg iron core tanks generated by the separation of the lower-yoke iron core tank therefrom by fitting a bottom plate thereto to form the erection tank.

There is also presented a U-shaped iron core assembling device including: a U-shaped iron core assembling tank which can be divided into an erection tank constituted by a first leg iron core tank for housing a first leg iron core and transporting the first leg iron core to an installation site and a second leg iron core tank for housing a second leg iron core and transporting the second leg iron core to the installation site and a lower-yoke iron core assembling tank; and a portal lifter for erecting the erection tank housing a U-shaped iron core at the installation site, wherein the first leg iron core tank comprises: a first opening/closing longitudinal opening portion formed in one longitudinal side surface; and a first opening/closing short opening portion formed in an end surface perpendicular to the one longitudinal side surface, the second leg iron core tank comprises; a second opening/closing longitudinal opening portion formed in one longitudinal side surface; a second opening/closing short opening portion formed in the end surface perpendicular to the side surface in which the second longitudinal opening portion is formed; and erection tank connecting means for connecting the second longitudinal opening portion which is opened in a state where the second leg iron core is housed in the second leg iron core tank and the first longitudinal opening portion which is opened in a state where the first leg iron core is housed in the first leg iron core tank for integration of the first leg iron core tank and the second leg iron core tank so as to constitute an erection tank, such that the first short opening portion and the second short opening portion are arranged in a single plane so as to become one opening portion, and the lower-yoke iron core assembling tank comprises: a third opening/closing opening portion which is formed in one longitudinal side surface of the lower-yoke iron core and through which the lower-yoke iron core can be carried in/out; and lower-yoke iron core assembling tank connecting means for connecting the third opening portion which is opened in a state where the lower-yoke iron core is housed in the lower-yoke iron core assembling tank and the first opened short opening portion and the second opened short opening portion of the erection tank housing the first leg iron core and the second leg iron core for integration of the erection tank and lower-yoke iron core assembling tank.

According to the present invention, it is possible to reduce the installation space, installation period, and installation cost in a transformer transporting/assembling method.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION OF THE INVENTION

Figure 1:
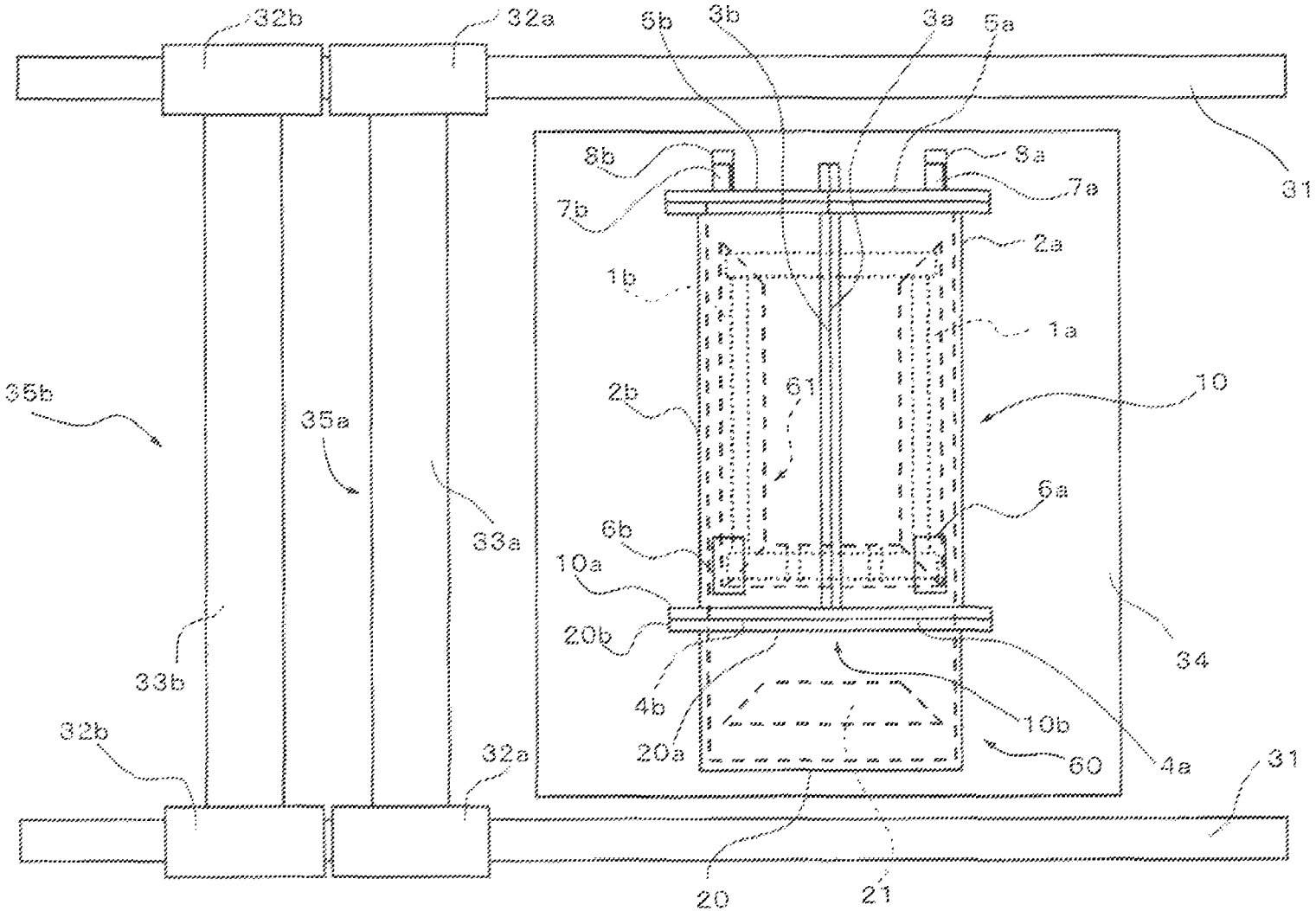
FIG. 1 is a schematic plan view showing an example of a portal lifter and a U-shaped iron core assembling tank according to a first embodiment of a transformer transporting/assembling method of the present invention.

Now, embodiments of the working apparatus and working method according to the present invention will be described referring to the accompanying drawings. Throughout the drawings, the same or similar components are denoted respectively by the same reference symbols and will not be described repeatedly.

Embodiments of the present invention will be described below with reference to the accompanying drawings. The same reference numerals are given to the same or corresponding parts throughout the drawings, and the description will not be repeated.

First Embodiment

Figure 2:
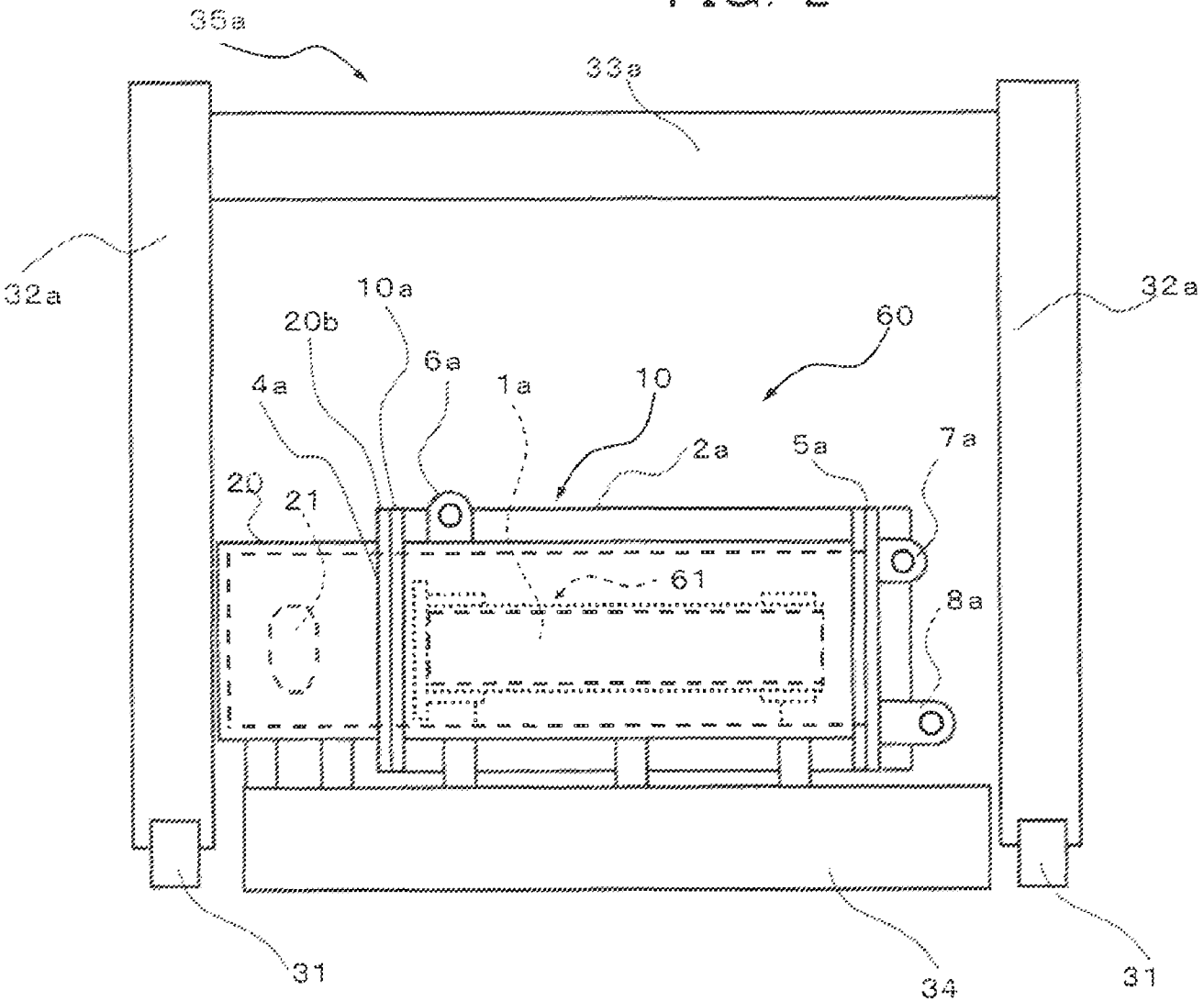
FIG. 2 is a schematic front view of the portal lifter and the U-shaped iron core assembling tank of FIG. 1.

FIG. 1 is a schematic plan view of an example of a first portal lifter 35*a*, a second portal lifter 35*b*, and a U-shaped iron core assembling tank 60 according to a first embodiment, which schematically shows a state where the U-shaped iron core assembling tank 60 housing a U-shaped iron core 61 is temporarily disposed on an assembling stand 34. FIG. 2 is a schematic front view of FIG. 1.

The U-shaped iron core 61 constituting a transformer, etc. includes a first leg iron core 1*a*, a second leg iron core 1*b*, a lower-yoke iron core 21, and the like.

The first leg iron core 1*a*, the second leg iron core 1*b*, and the lower-yoke iron core 21 are transported to an installation site of a transformer, etc. by a first leg iron core tank 2*a*, a second leg iron core tank 2*b*, and a lower-yoke iron core transporting tank (not shown), respectively. At this time, the first leg iron core 1*a* and the second leg iron core 1*b* are housed in the first leg iron core tank 2*a* and the second leg iron core tank 2*b* respectively in a sideways attitude such that the longitudinal direction thereof is oriented in the horizontal direction and respective stacked steel plates extend in the horizontal direction and are transported to the installation site in this state.

The first leg iron core tank 2*a* has a first opening/closing longitudinal opening portion 3*a* formed in one side surface in the longitudinal direction and a first short opening portion 4*a* formed in the end surface perpendicular to the one side surface. Detachable lids (not shown) such as iron plates are fitted to the first longitudinal opening portion 3*a* and the first short opening portion 4*a*. When the iron core, etc. is housed in the tank or transported, the opening portions are closed by the lids. Further, a first end plate 5*a* is positioned in the end surface opposed to the first short opening portion 4*a*.

Like the first leg iron core tank 2*a*, the second leg iron core tank 2*b* has an opening/closing second longitudinal opening portion 3*b* formed in one side surface in the longitudinal direction and a second short opening portion 4*b* formed in the end surface perpendicular to the one side surface. Lids such as iron plates are fitted to the second longitudinal opening portion 3*b* and the second short opening portion 4*b*. When the iron core, etc. is housed in the tank or transported, the opening portions are closed by the lids. Further, a second end plate 5*b* is positioned in the end surface opposed to the second short opening portion 4*b*. Flange portions, etc., are formed surrounding these opening portions so as to allow connection between the respective tanks.

In order to place a portal lifter at the installation site of a transformer, etc., two traveling rails 31 are laid in parallel to each other. After the traveling rails 31 have been laid, extensible first booms 32*a* capable of being moved up and down by, e.g., a hydraulic pressure are set on the traveling rails 31 respectively so as to be opposite to each other. Further, a first beam 33*a* is placed over the first booms 32*a* so as to connect them, whereby assembly of the first portal lifter 35*a* is completed. The opposing first booms 32*a* are extended or contracted so that they are the same length. Similarly, in the present embodiment, second booms 32*b* and a second beam 33*b* are set so as to assemble the second portal lifter 35*b*. The first booms 32*a* and the second booms 32*b* are extended and contracted such that the first beam 33*a* and the second beam 33*b* do the same movement. With this configuration, it is possible to construct a conveyor capable of hoisting up a heavy load of at least 60-ton class with a positioning accuracy of several millimeters.

An assembling stand 34 is disposed at a flattened center portion inside the two traveling rails 31 on which the first portal lifter 35*a* and the second portal lifter 35*b* are set. On the assembling stand 34, the first leg iron core tank 2*a* and the second leg iron core tank 2*b* are temporarily disposed in a sideways attitude after being transported. At this time, the first leg iron core tank 2*a* housing the first leg iron core 1*a* and the second leg iron core tank 2*b* housing the second leg iron core 1*b* are disposed such that the longitudinal directions of the tanks are made parallel to each other. Further, the first short opening portion 4*a* and the second short opening portion 4*b* are arranged in the single plane, and the first longitudinal opening portion 3*a* and the second longitudinal opening portion 3*b*, which are set in an open state, are arranged opposite to each other.

In this state, the first longitudinal opening portion 3*a* and the second longitudinal opening portion 3*b* are connected to each other so as to integrate the first leg iron core tank 2*a* and the second leg iron core tank 2*b*. A tank obtained by integrating the first leg iron core tank 2*a* and the second leg iron core tank 2*b* is referred to as an erection tank 10.

In the erection tank 10, the first short opening portion 4*a* and the second short opening portion 4*b* are arranged in the single plane. These opening portions 4*a* and 4*b* constitute one opening in an open state. This opening is referred to as an erection tank opening portion 10*b*. After the formation of the erection tank 10, the flanges formed surrounding the first short opening portion 4*a* and the second short opening portion 4*b* constitute one flange. The thus obtained flange is referred to as an erection tank flange 10*a*. Further, the erection tank 10 has hoisting lugs which can be connected to, e.g., the first portal lifter 35*a* by a wire, etc. As the hoisting lugs, a first upper side short hoisting lug 7*a*, a second upper side short hoisting lug 7*b*, a first upper side long hoisting lug 8*a*, and a second upper side long hoisting lug 8*b* are provided on the upper end surface of the erection tank 10, and a lower side hoisting lug 6*a* and a lower side hoisting lug 6*b* are provided in the lower portion of the erection tank 10.

The lower-yoke iron core 21 is transported to the installation site by a lower-yoke iron core transporting tank (not shown). A lower-yoke iron core assembling tank 20 has a third opening portion 20*a* which is formed in one longitudinal side thereof and which has a flange portion formed therearound. The third opening portion 20*a* can be opened and closed, through which carry-in and carry-out of the lower-yoke iron core 21 can be performed. The flange formed around the third opening portion 20*a* is referred to as a third opening portion flange 20*b*. At the installation site, the lower-yoke iron core 21 is carried out from the lower-yoke iron core transporting tank by, e.g., a crane or a tow truck and carried into the lower-yoke iron core assembling tank 20 through the third opening portion 20*a*. At this time, the lower-yoke iron core 21 is carried into the lower-yoke iron core assembling tank 20 in such a manner that the longitudinal direction thereof is parallel to the horizontal direction. The lower-yoke iron core 21 may be housed in the lower-yoke iron core assembling tank 20 in a factory, etc. and transported to the installation site in this state.

The lower-yoke iron core assembling tank 20 in which the lower-yoke iron core 21 has been housed is disposed such that the erection tank opening portion 10*b* of the erection tank 10 disposed on the assembling stand 34 and the third opening portion 20*a* are opposed to each other. At this time, the lower-yoke iron core assembling tank 20 is disposed using a crane, etc. such that the angle defined by a side surface in which the first longitudinal opening portion 3*a* and the second longitudinal opening portion 3*b* are formed and a surface having the third opening portion 20*a* is set to 90 degrees. In FIGS. 1 and 2, the lower-yoke iron core 21 is shown in the erection tank 10 and lower-yoke iron core assembling tank 20, respectively.

In a state where the erection tank opening portion 10*b* and the third opening portion 20*a* are opened, the erection tank flange 10*a* and the third opening portion flange 20*b* are connected so as to integrate the erection tank 10 and lower-yoke iron core assembling tank 20. The thus obtained tank is referred to as a U-shaped iron core assembling tank 60.

Immediately after the formation of the U-shaped iron core assembling tank 60, the first leg iron core 1*a* and the second leg iron core 1*b* are disposed parallel to each other such that the extend lines of the leg iron cores in the longitudinal direction cross at right angles the longitudinal side of the lower-yoke iron core 21. In this state, these iron cores are separated. When the three tanks are connected with the lids of the opening portions removed, or when an erection tank bottom plate 10*c* is fitted after removal of the lower-yoke iron core assembling tank 20, the opening portions open not upward but in the horizontal. Thus, it is possible to prevent dust from entering the tank.

After that, the lower-yoke iron core 21 is connected to the end portions of the first leg iron core 1*a* and the second leg iron core 1*b* to assemble the U-shaped iron core 61. More specifically, the lower-yoke iron core 21 housed in the lower-yoke iron core assembling tank 20 is connected to the lower ends of the first leg iron core 1*a* and the second leg iron core 1*b* disposed parallel to each other. That is, when the fitting of the lower-yoke iron core 21 to the lower ends of the first leg iron core 1*a* and the second leg iron core 1*b* is completed, the U-shaped iron core 61 is housed in the erection tank 10.

In a state where the assembly of the U-shaped iron core 61 has been completed, the longitudinal directions of the first leg iron core 1*a*, the second leg iron core 1*b*, and the lower-yoke iron core 21 are all in a horizontal state. That is, when viewed from above, the entire integrated iron core has a U-shape.

Figure 3:
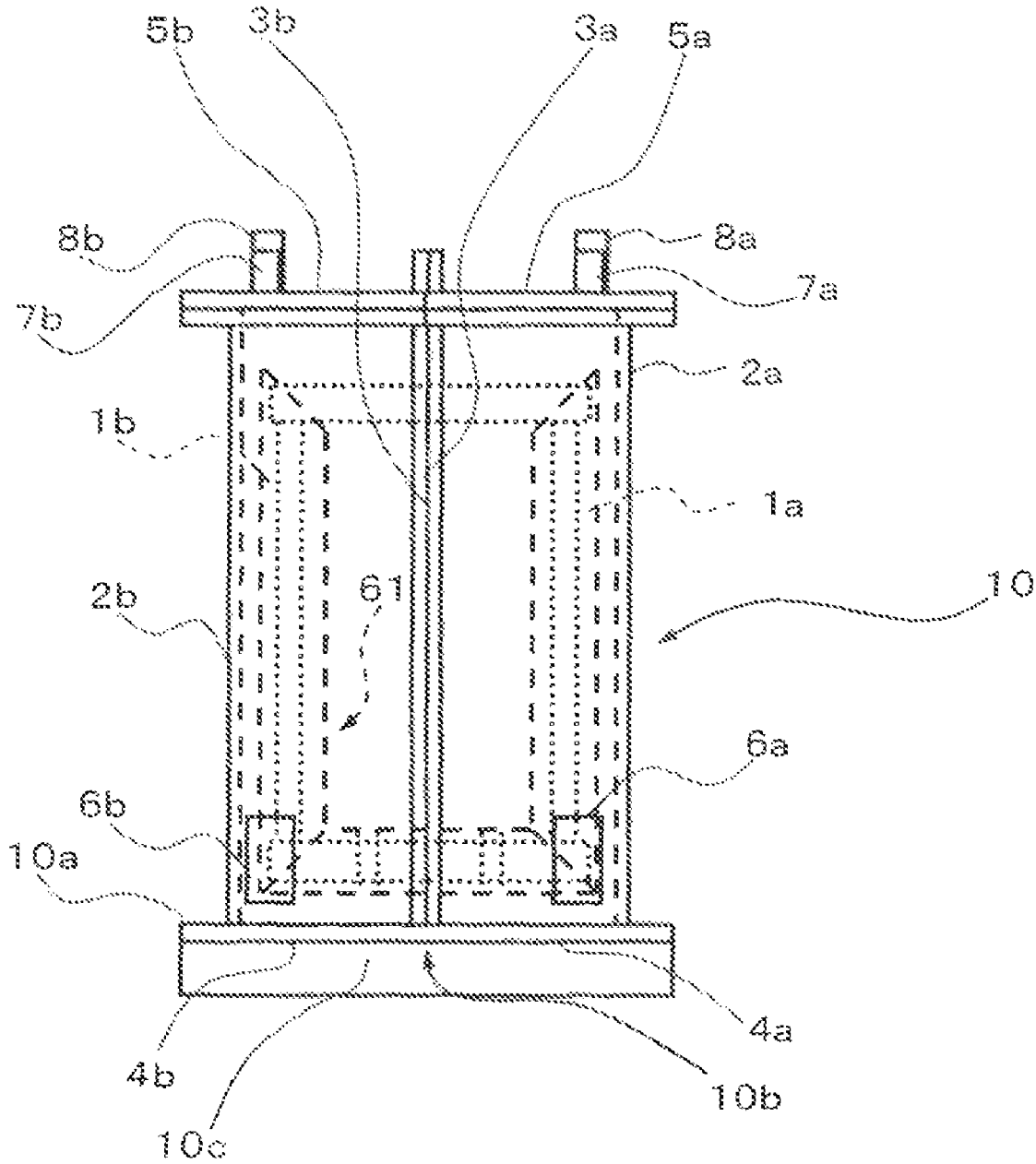
FIG. 3 is a schematic plan view showing an example in which a U-shaped iron core is housed in an erection tank of FIG. 1.

FIG. 3 is a schematic plan view showing a state where the U-shaped iron core 61 is housed in the erection tank 10 and the erection tank opening portion 10*b* is closed. After the assembly of the U-shaped iron core 61 has been completed, connection between the erection tank opening portion 10*b* and third opening portion 20*a* is released, and the erection tank opening portion 10*b* is closed by the erection tank bottom plate 10*c* such as an iron plate. With the above processes, a state where the assembled U-shaped iron core 61 is housed in the erection tank 10 is obtained.

Next, an erecting process of erecting the erection tank 10 that has been temporarily disposed in a sideways attitude on the assembling stand 34 will be described.

Figure 4:
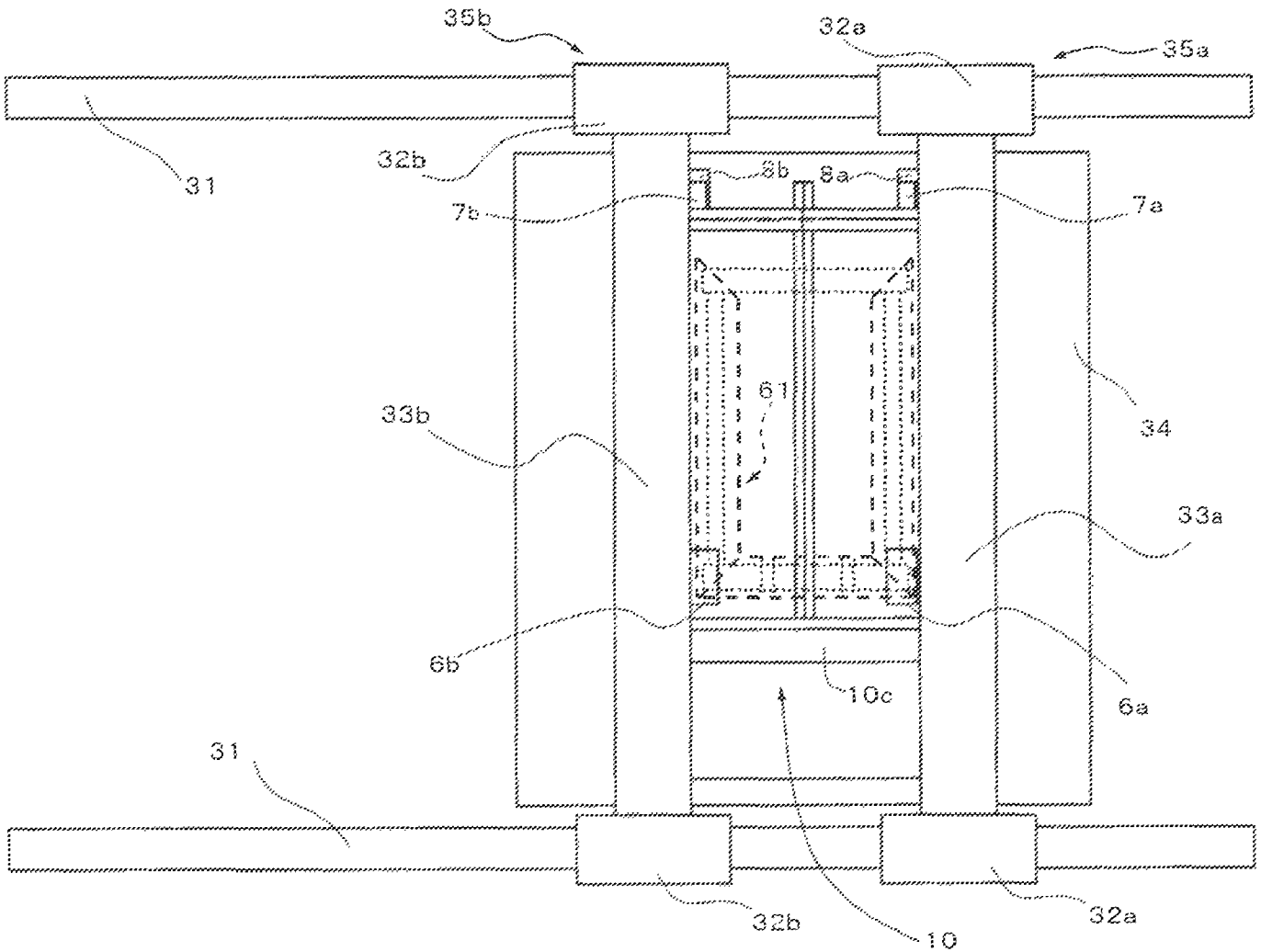
FIG. 4 is a schematic plan view showing an example in which the erection tank is disposed on an assembling stand of FIG. 1 and first and second beams are positioned over the erection tank.
Figure 5:
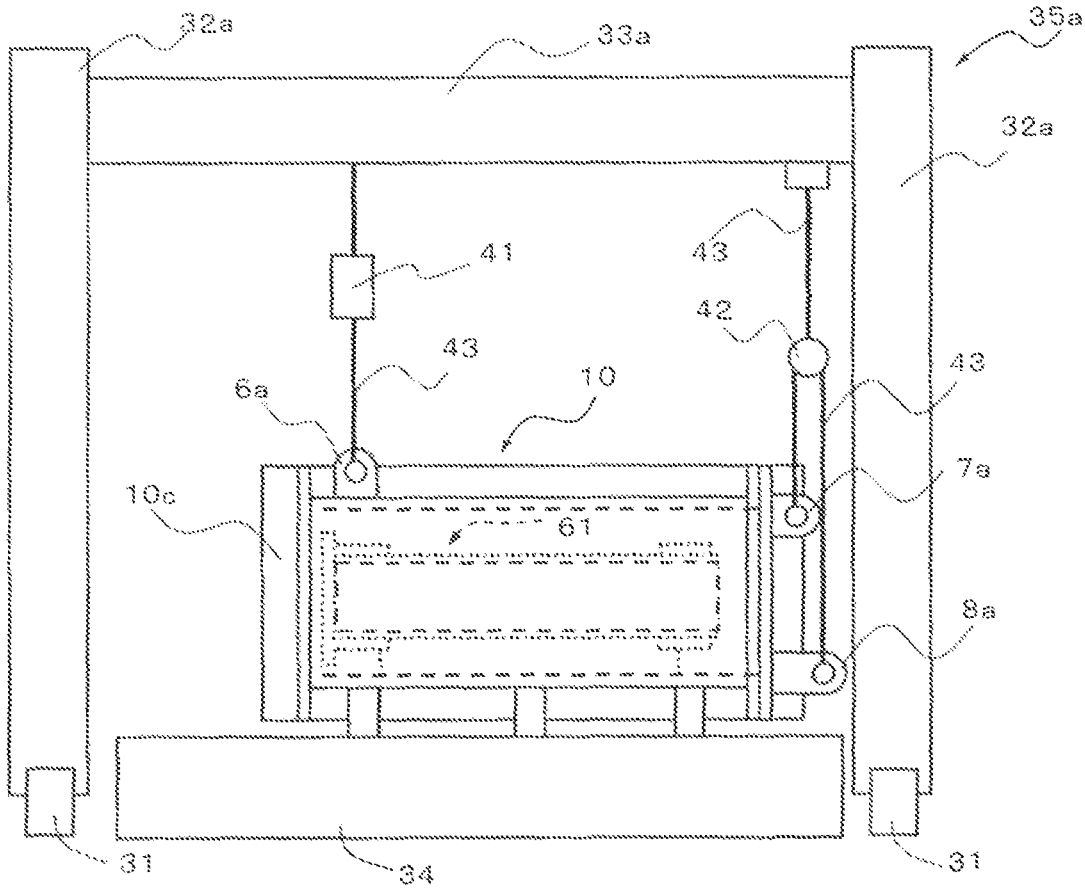
FIG. 5 is a schematic front view showing the portal lifters and the erection tank of FIG. 4.

FIG. 4 is a schematic plan view showing a state where the erection tank 10 housing the U-shaped iron core 61 is disposed on the assembling stand 34. FIG. 5 is a schematic front view of FIG. 4.

The first portal lifter 35*a* and the second portal lifter 35*b* are moved on the traveling rails 31 up to the positions corresponding to the hoisting lugs, and the positions of the first beam 33*a* and the second beam 33*b* are adjusted so as to be positioned just above the hoisting lugs. That is, the first upper side short hoisting lug 7*a*, the first upper side long hoisting lug 8*a*, and the first lower side hoisting lug 6*a* are positioned just below the first beam 33*a* of the first portal lifter 35*a*, and the second upper side short hoisting lug 7*b*, the second upper side long hoisting lug 8*b*, and the second lower side hoisting lug 6*b* are positioned just below the second beam 33*b* of the second portal lifter 35*b*.

A chain block 41 is positioned between, e.g., the first beam 33*a* and the first lower side hoisting lug 6*a*. Flexible members, such as wires 43, are hooked to the first upper side long hoisting lug 8*a* and the first upper side short hoisting lug 7*a* of the erection tank 10, and the wires 43 are connected to the first beam 33*a* through a pulley 42. Similarly, on the second portal lifter 35*b* side, at least one wire 43 is hooked to the second upper side long hoisting lug 8*b* and the second upper side short hoisting lug 7*b*, and the wire 43 is connected to the second beam 33*b* through the pulley 42.

Figure 6:
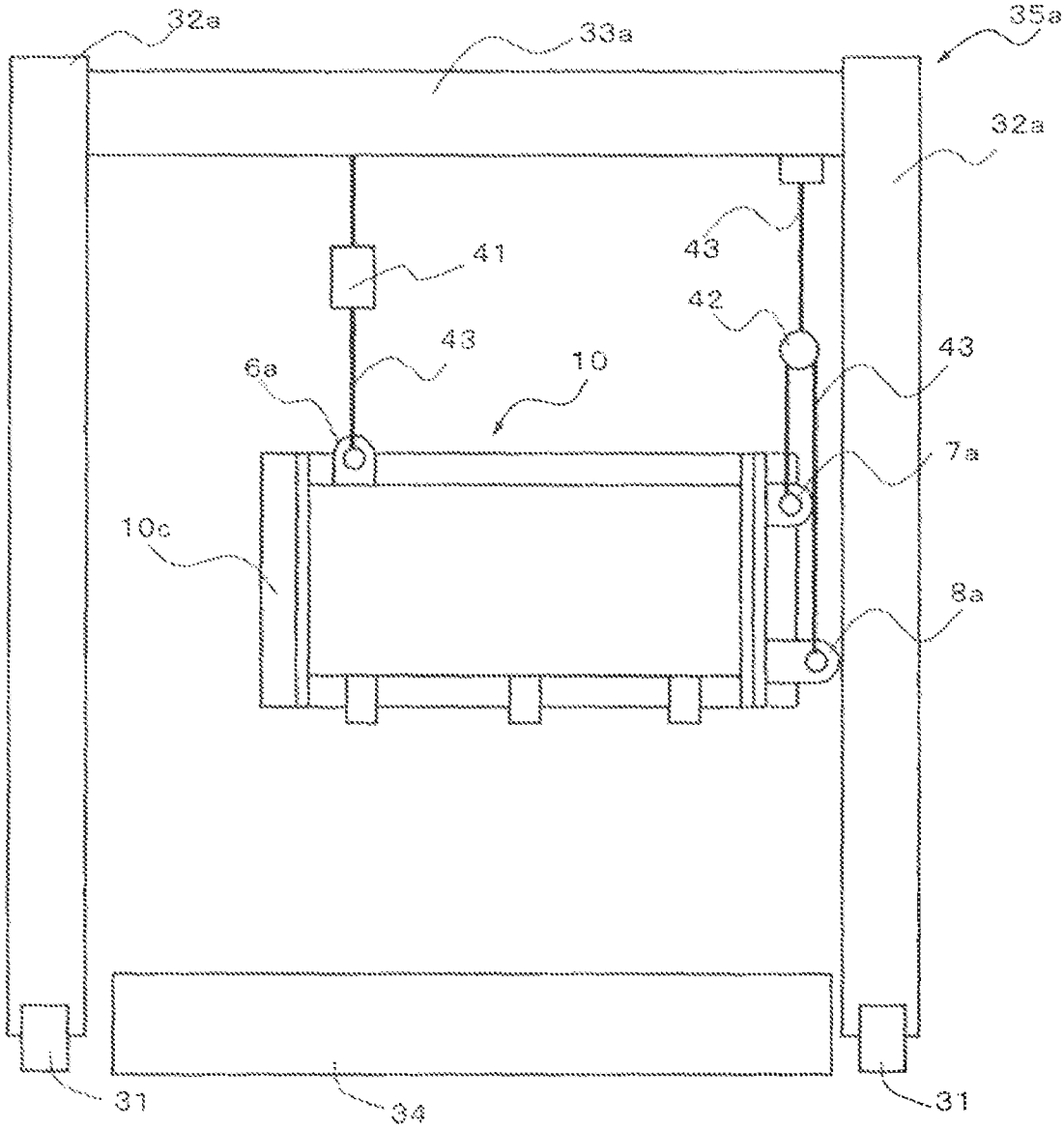
FIG. 6 is a schematic front view showing an example in which the erection tank is lifted in a sideways attitude in the first embodiment.

FIG. 6 is a schematic front view showing an example in which the erection tank 10 is lifted in a sideways attitude in the erecting process according to the present embodiment. The pulley 42 is lifted by the first portal lifter 35*a*, and the first booms 32*a* of the first portal lifter 35*a* are extended, whereby the erection tank 10 is lifted in a sideways attitude. At the same time, the second booms 32*b* of the second portal lifter 35*b* are also extended.

Figure 7:
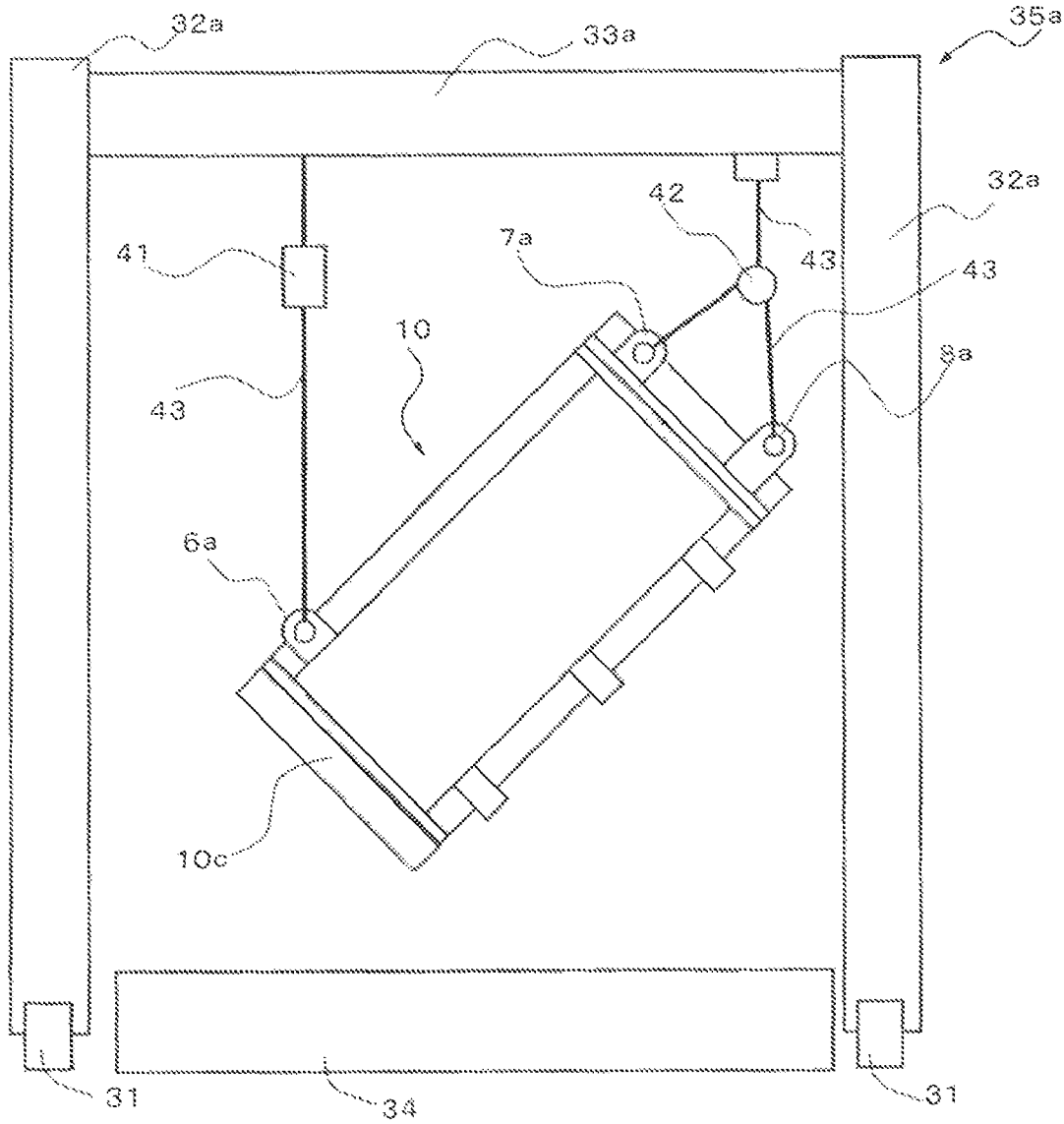
FIG. 7 is a schematic front view showing an example in which the erection tank is rotated by about 45 degrees in the first embodiment.

FIG. 7 is a schematic front view showing an example in which the erection tank 10 is rotated by about 45 degrees in the erecting process of the present embodiment. After the erection tank 10 is lifted in a sideways attitude, the chain blocks 41 are slowly hoisted down. As a result, the wire 43 is smoothly moved on the pulleys 42, allowing the erection tank 10 to be rotated.

Figure 8:
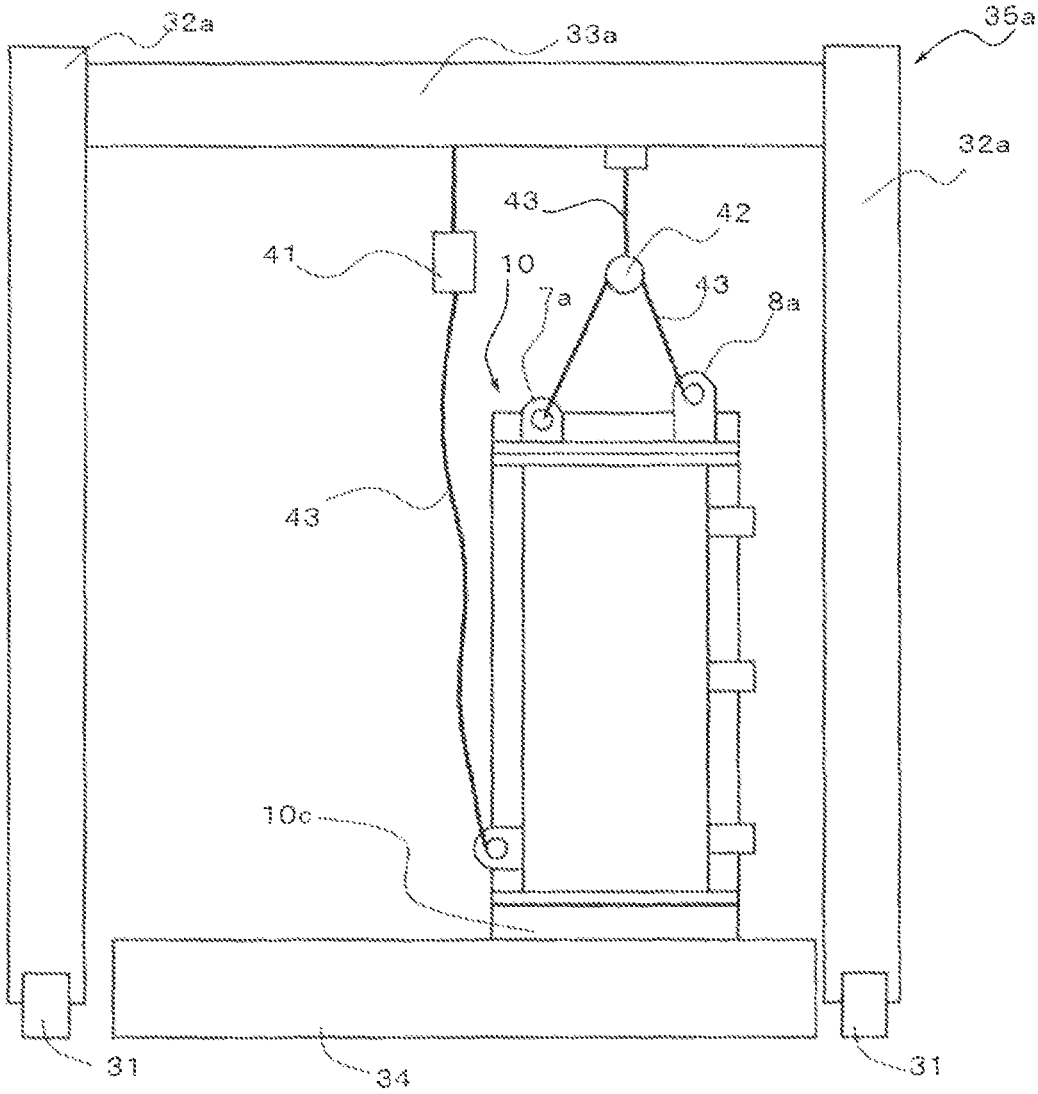
FIG. 8 is a schematic front view showing an example in which the erecting process of the erection tank in the first embodiment has been completed.

FIG. 8 is a schematic front view showing an example in which the erection tank 10 has been erected after the completion of the rotation operation shown in FIG. 7.

When the chain blocks 41 are loosened, one side of the erection tank bottom plate 10*c* of the erection tank 10 is brought into contact with the assembling stand 34. Then, a force acting on the wire 43 hooked to the first lower side hoisting lug 6*a* gradually becomes small, causing the erection tank 10 to be erected. That is, the attitude of the erection tank has been rotated by substantially 90 degrees and the erection tank bottom plate 10*c* becomes the bottom surface. Thus, the erecting process of the erection tank 10 has been completed.

Conventionally, at least two tow trucks are required in order to perform the erecting process. On the other hand, the first portal lifter 35*a* and the second portal lifter 35*b* can be transported in a disassembled condition, and the weight of unit to be transported is 2 to 3 tons, so that the first and second portal lifters 35*a* and 35*b* can be transported by comparatively small ordinarily trucks.

According to the transformer transporting/assembling method performed in the present embodiment, a large heavy device and an overhead traveling crane are not used in the erecting process of the erection tank 10, so that it is possible to reduce the working space required for the erecting process, thereby achieving reduction in the installation space. Further, the rental fee for at least two heavy devices becomes unnecessary, thereby reducing cost.

Further, in the present embodiment, it is possible to assemble the U-shaped iron core 61 in an environment almost isolated from the ambient air without using an assembly room, such as a clean house, for assembling the U-shaped iron core 61, transformer, or the like, at the installation site. This allows both assembling processes of the U-shaped iron core 61 and, e.g., a transformer assembly cleans house to be performed simultaneously, thereby reducing the entire transformer installation period and the installation cost.

Second Embodiment

Figure 9:
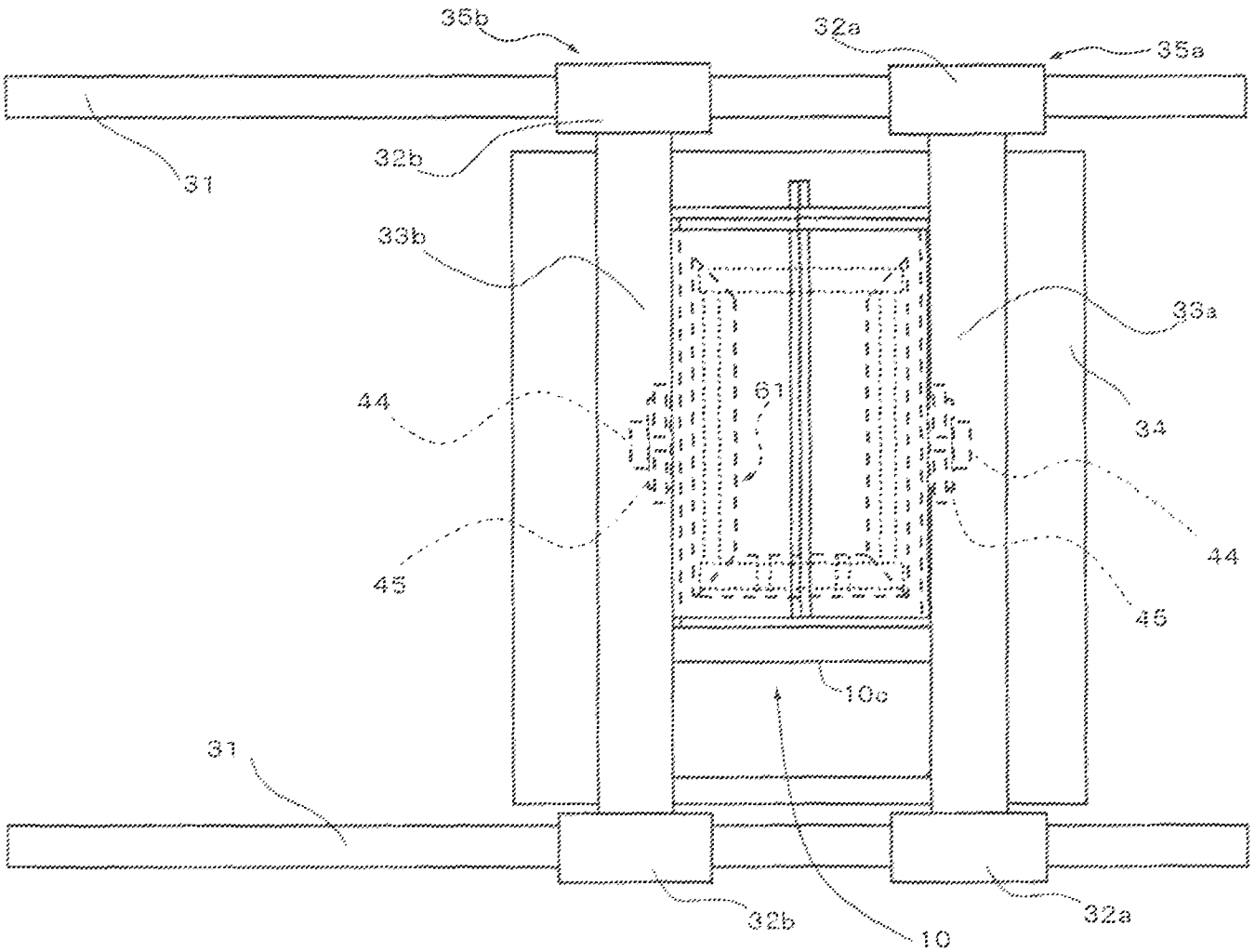
FIG. 9 is a schematic plan view of an example of the portal lifter and the erection tank according to a second embodiment of the transformer transporting/assembling method of the present invention.
Figure 10:
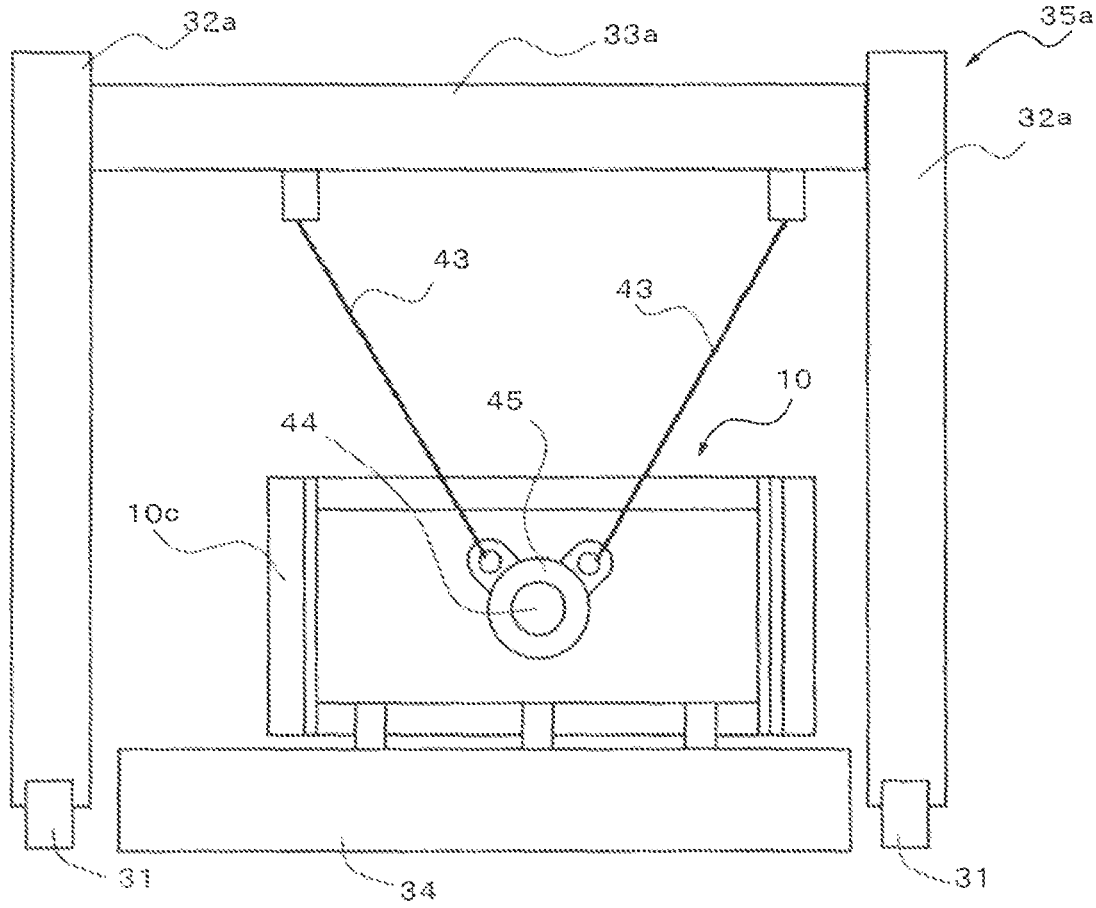
FIG. 10 is a schematic front view of the portal lifter and the erection tank of FIG. 9.

FIG. 9 is a schematic plan view of an example of the first portal lifter 35*a*, the second portal lifter 35*b*, and the erection tank 10 according to a second embodiment of the transformer transporting/assembling method of the present invention, which schematically shows a state where the erection tank 10 is temporarily disposed on the assembling stand 34. FIG. 10 is a schematic front view of FIG. 9.

In the present embodiment, hoisting pins 44 are each formed by welding in the center of one side surface of the erection tank 10 at a portion slightly father from the erection tank bottom plate 10*c* than the rotational center of the erection tank 10 is from the erection tank bottom plate 10*c*. Further, hoisting rings 45 are each fitted to the hoisting pin 44 by, e.g., interference fitting. The first portal lifter 35*a* has a configuration in which the first beam 33*a* and the hoisting ring 45 are connected to each other by the wire 43 so as to lift the erection tank 10.

The transformer transporting/assembling method according to the present embodiment will be described below. First, as in the case of the first embodiment, the first portal lifter 35*a*, the second portal lifter 35*b*, and the like are assembled, the assembling stand 34 is disposed between the traveling rails 31, and the erection tank 10 according to the present embodiment housing the U-shaped iron core 61 in a sideways attitude is temporarily disposed on the assembling stand 34.

The first booms 32*a* and the second booms 32*b* are extended to lift each hoisting ring 45 connected to the wire 43, and the erection tank 10 is lifted while being rotated about the hoisting pins 44 to which each hoisting ring 45 is fitted. At this time, each hoisting ring 45 and the like are positioned slightly away from the erection tank bottom plate 10*c* and thereby the weight becomes larger on the erection tank bottom plate 10*c*, allowing the erection tank 10 to be rotated in such a direction that the erection tank bottom plate 10*e* faces down.

Figure 11:
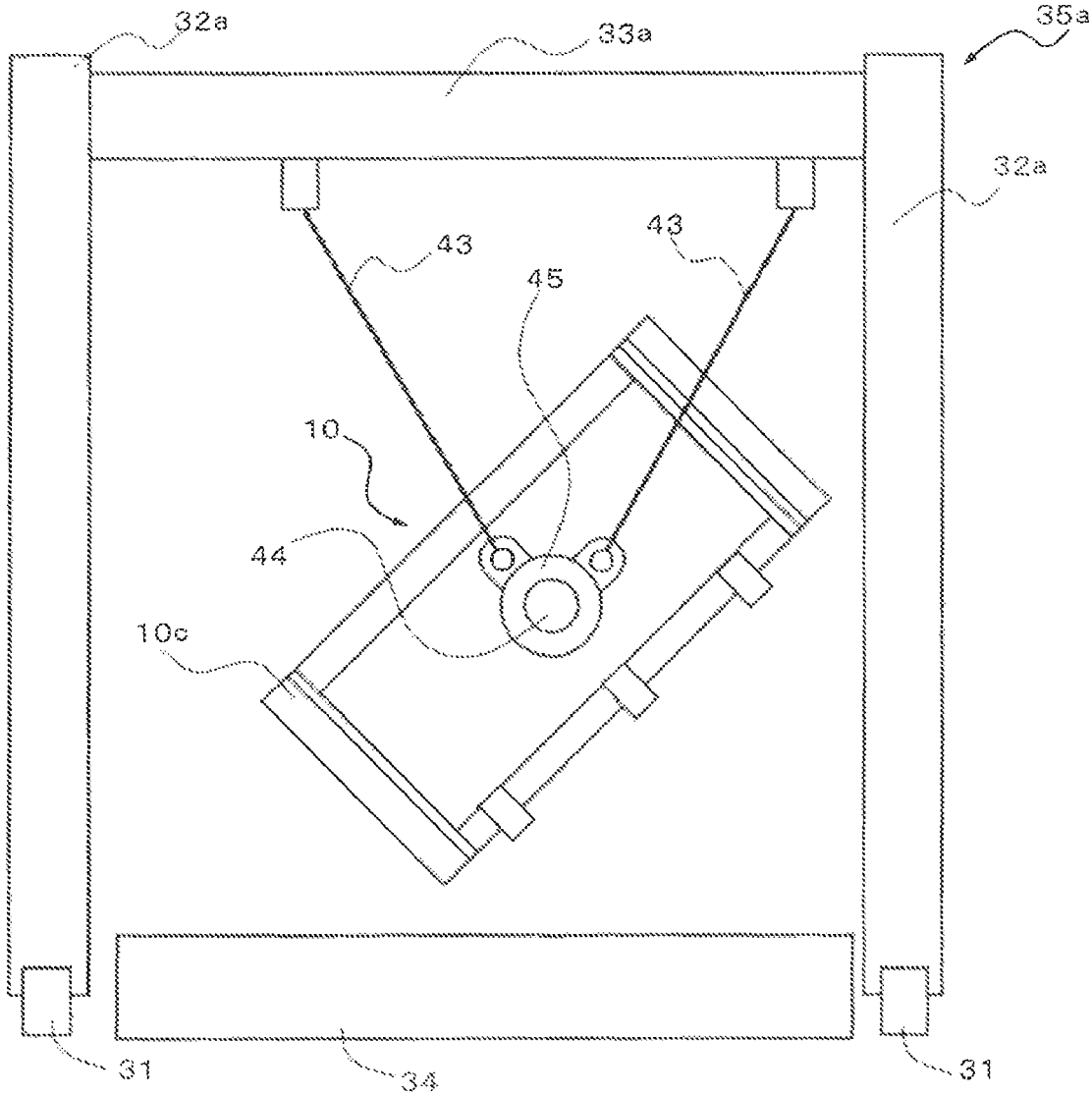
FIG. 11 is a schematic front view showing an example of a state where the erection tank in FIG. 9 is being rotated.
Figure 12:
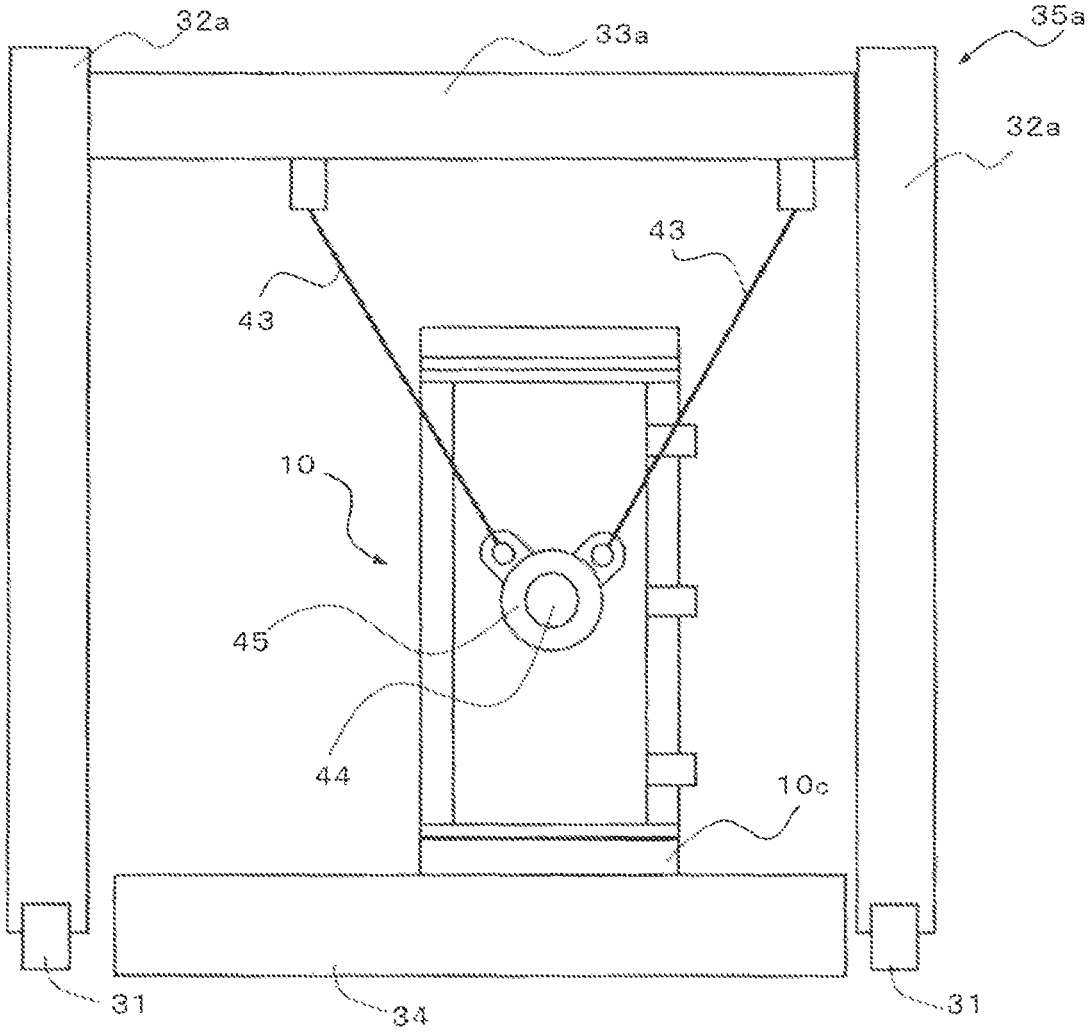
FIG. 12 is a schematic front view showing a state where the erecting process of the erection tank of FIG. 9 has been completed.

FIG. 11 is a schematic front view showing an example of a state where the erection tank 10 according to the present embodiment is being rotated, and FIG. 12 is a schematic front view showing a state where the erecting process has been completed.

According to the present embodiment, the chain blocks 41, pulleys 42, and the like employed in the erecting process need not be arranged. That is, it is possible to achieve the erecting process using less equipment than in the first embodiment. The erection tank 10 can be rotated by only the extension of the first booms 32*a* and the second booms 32*b*, thereby simplifying the erecting process.

Further, the rotational center is positioned at substantially the center between the traveling rails 31, so that a space for the erecting process can be reduced as compared to the first embodiment.

Figure 13:
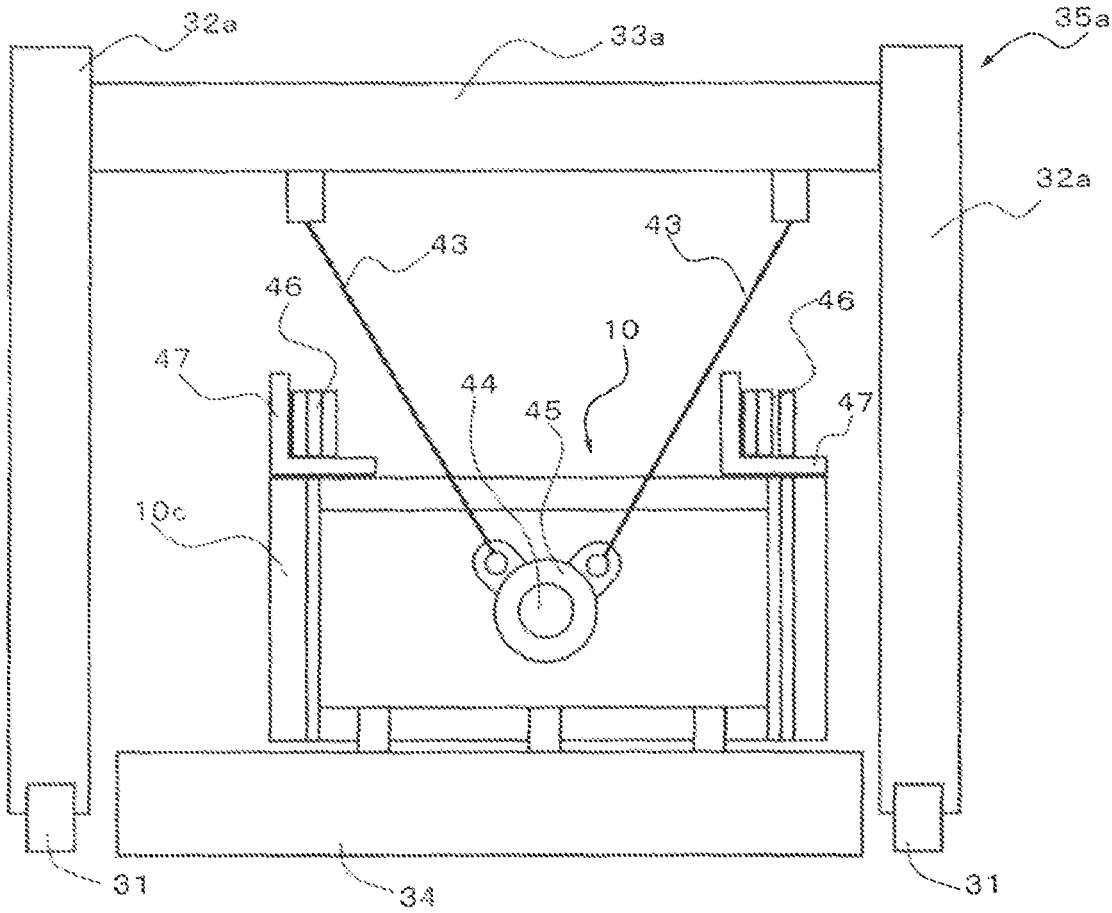
FIG. 13 is a schematic front view showing an example in which a seat to which an additional weight can be attached is mounted on the upper side surface of the erection tank of FIG. 9 in a sideways attitude.

Further, as shown in FIG. 13, a seat 47 to which an additional weight 46 can be attached may be optionally mounted on the erection tank 10 at a portion on the erection tank bottom plate 10*a* side so as to control weight balance. Thus, even when the U-shaped iron cores 61 having different dimensions are housed in the erection tank 10, it is possible to perform the rotation operation of the erection tank 10 as in the case of the above example by controlling the weight balance, allowing the erection tank 10 to be erected.

Third Embodiment

Figure 14:
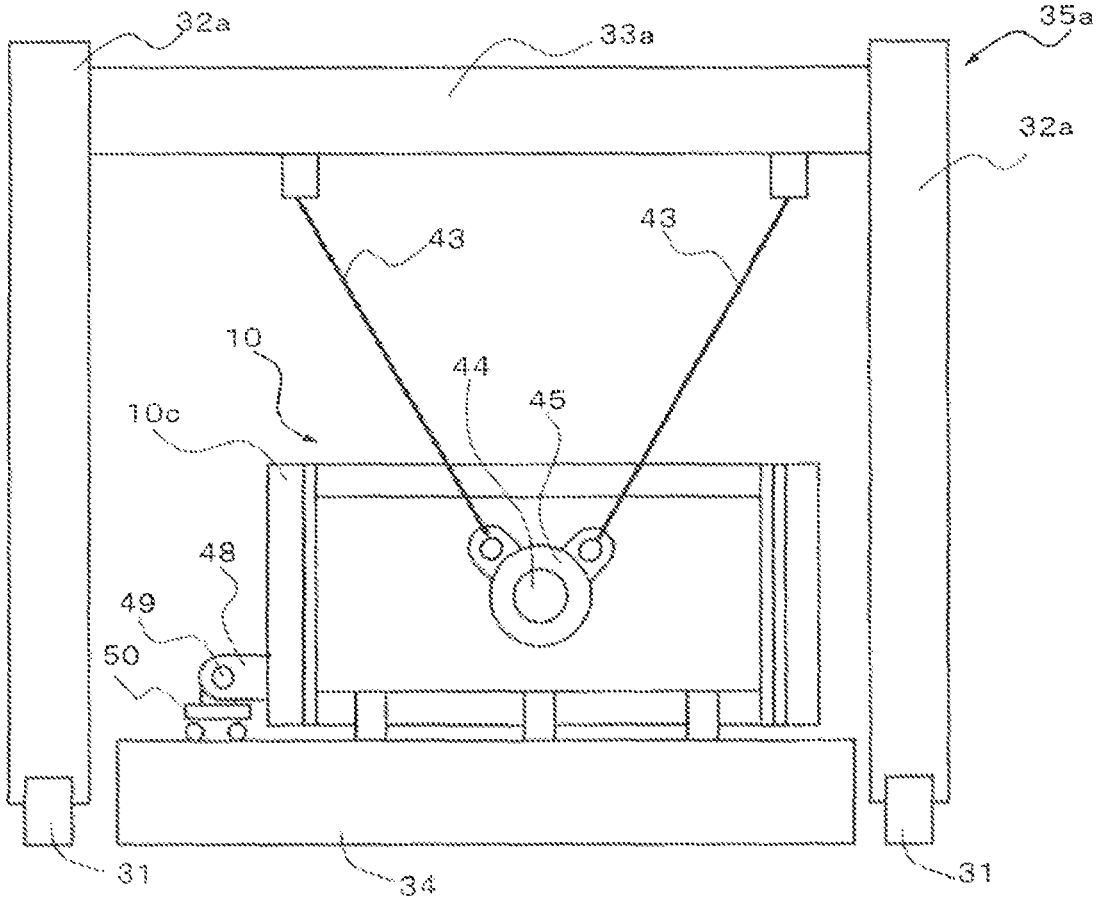
FIG. 14 is a schematic front view of an example of the portal lifter and the erection tank according to a third embodiment of the transformer transporting/assembling method of the present invention.

FIG. 14 is a schematic front view of an example of the first portal lifter 35*a* and the erection tank 10 according to a third embodiment of the transformer transporting/assembling method of the present invention, which schematically shows a state where the erection tank 10 is temporarily disposed on the assembling stand 34. In the present embodiment, connection seats 48 are mounted at the lower portion of the erection tank 10 in addition to the components of the second embodiment. The connection seats 48 are respectively connected to traveling carriages 50 each of which can travel on the assembling stand 34 by a connection pin 49, etc.

The transformer transporting/assembling method according to the present embodiment will be described below. First, as in the case of the first embodiment, the first portal lifter 35*a* and the second portal lifter 35*b* are assembled, the assembling stand 34 is disposed between the traveling rails 31, and the erection tank 10 according to the present embodiment housing the U-shaped iron core 61 in a sideways attitude is temporarily disposed on the assembling stand 34.

Figure 15:
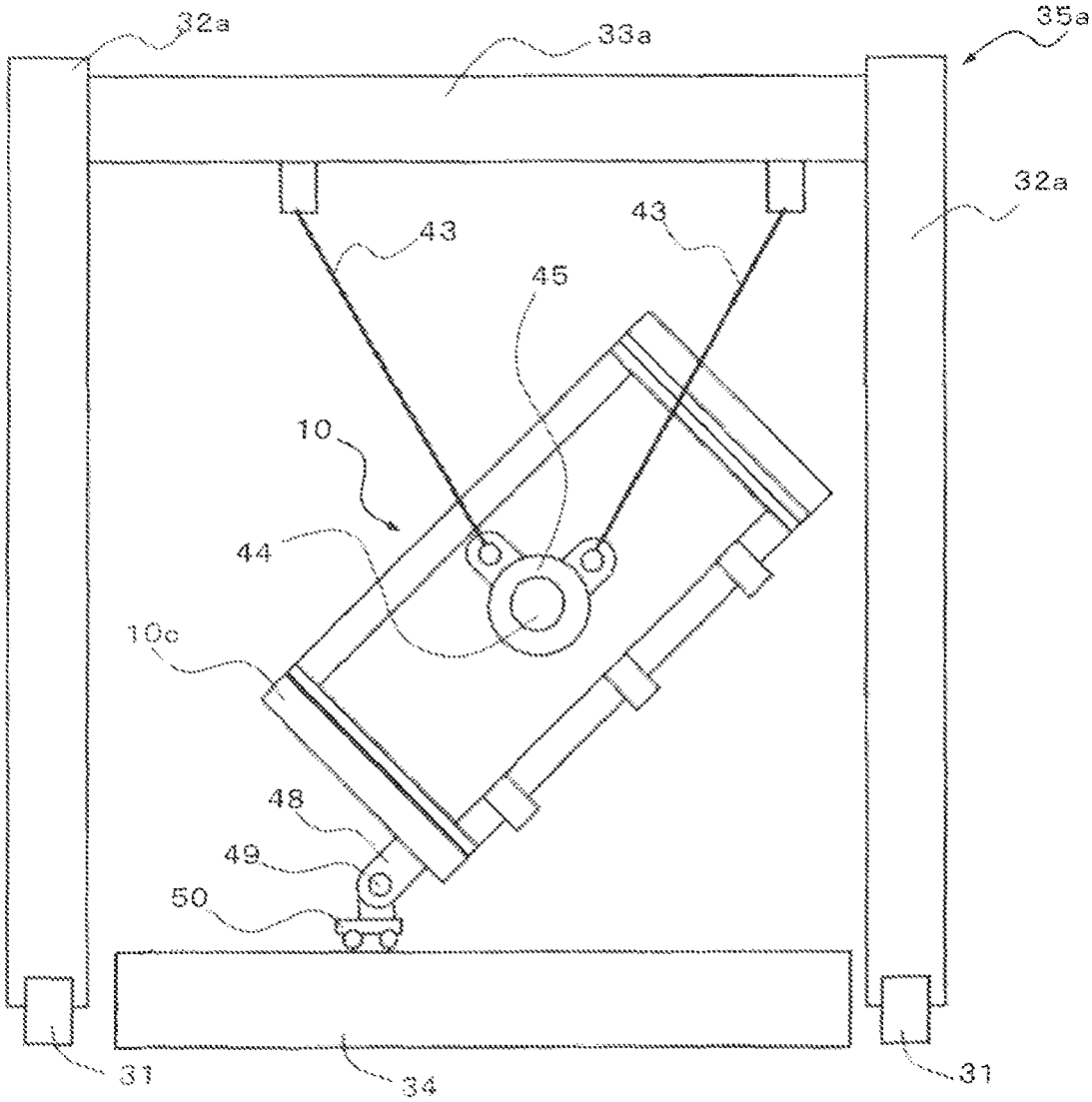
FIG. 15 is a schematic front view showing an example of a state where the erection tank of FIG. 14 is being rotated.

FIG. 15 is a schematic front view showing an example of a state where the erection tank 10 according to the present embodiment is being rotated. As in the case of the second embodiment, the first booms 32*a* and the second booms 32*b* are extended to lift each hoisting ring 45 connected to the wire 43, and the erection tank 10 is lifted while being rotated about the hoisting pins 44 to which each hoisting ring 45 is fitted. At this time, each traveling carriage 50 receives a load acting from the erection tank bottom plate 10*c* on the assembling stand to cause the erection tank 10 to be erected while traveling on the assembling stand 34.

Figure 16:
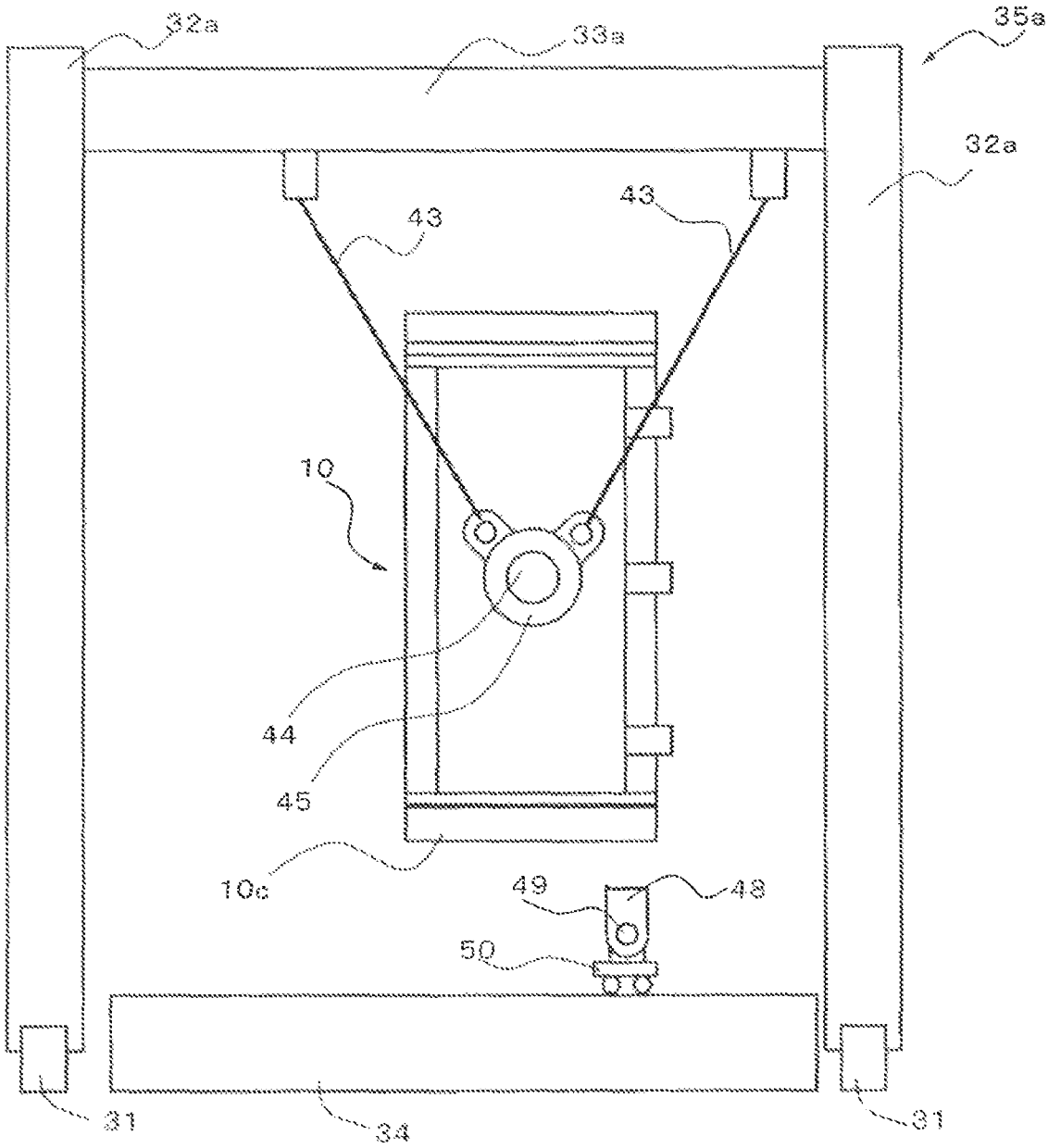
FIG. 16 is a schematic front view showing an example of a state where the hoisted erection tank of FIG. 14 is at rest in an erected attitude after the rotation operation thereof has been completed.

FIG. 16 is a schematic front view showing an example of a state where the hoisted erection tank 10 is at rest in an erected attitude after the rotation operation thereof has been completed. The connection seats 48 are removed from the erection tank 10 which is being at rest in an erected attitude after the completion of the rotation operation thereof, and the erection tank 10 is placed on the assembling stand 34, whereby the erecting process is completed.

According to the present embodiment, the erection tank 10 can be hoisted up such that the erection tank bottom plate 10*c* is not brought into contact with the assembling stand 34, thereby allowing the rotation operation of the erection tank 10 to be performed more smoothly. Further, the traveling carriages 50 are brought into contact with the assembling stand 34, so that the lateral swing of the erection tank 10 during the erecting operation can be prevented, thereby improving workability of the erecting process.

Figure 17:
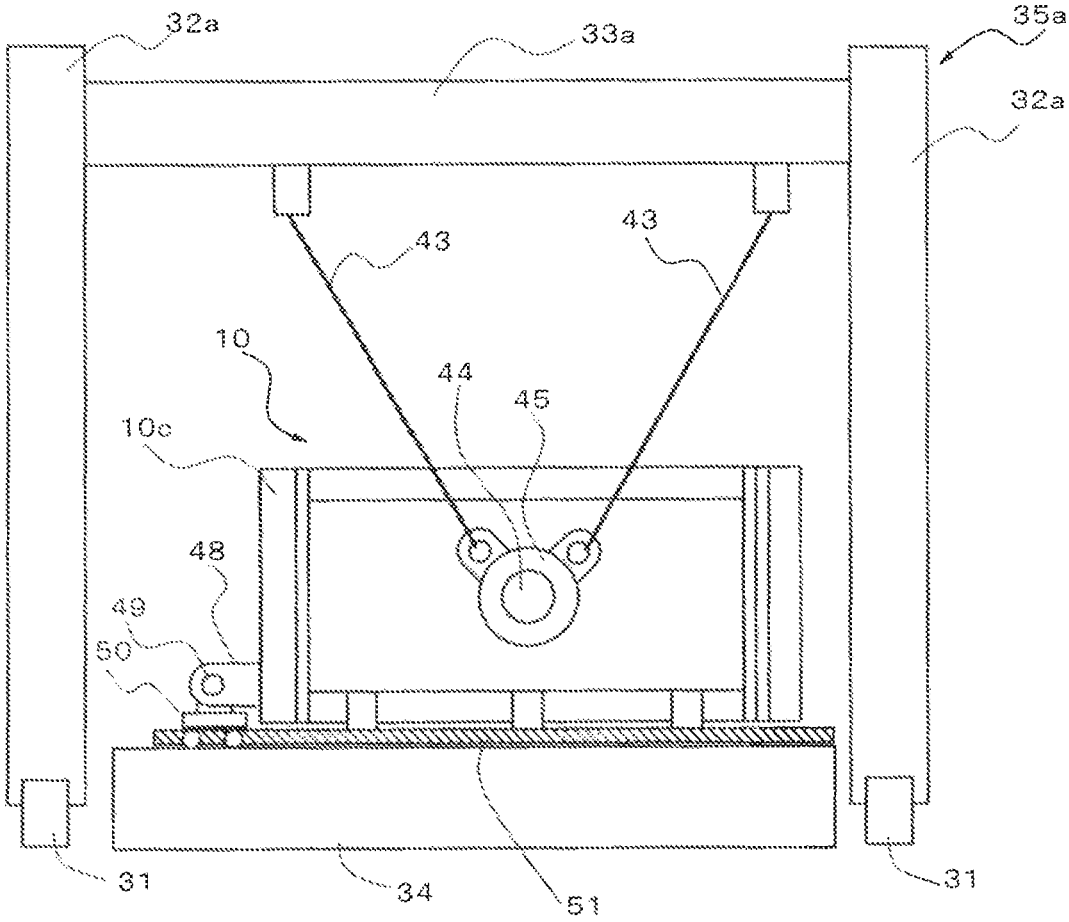
FIG. 17 is a schematic front view showing an example in which traveling guides are provided on the assembling stand in the present embodiment.
Figure 18:
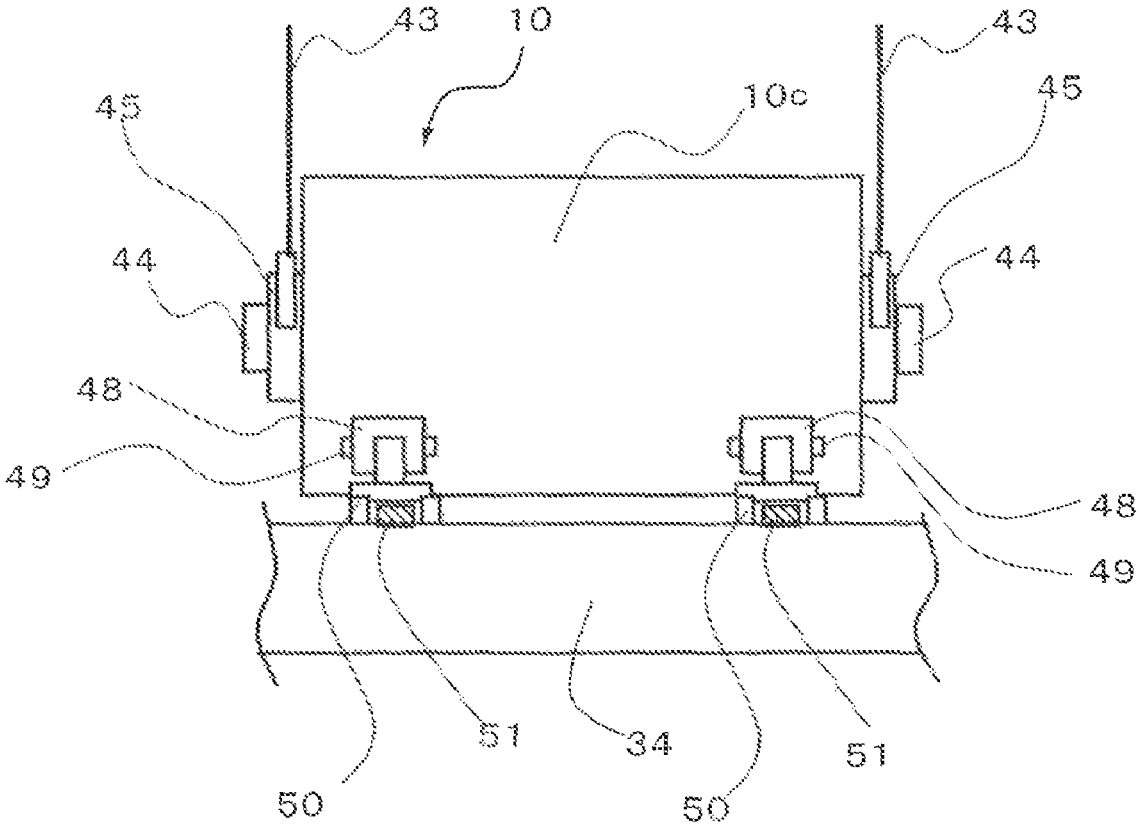
FIG. 18 is a schematic side view of FIG. 17.

Further, as shown in FIG. 17, traveling guides 51 may be provided on the assembling stand 34 so as to extend along the traveling rails of the traveling carriages 50. FIG. 18 is a schematic side view showing an example in which the traveling guides 51 are provided on the assembling stand 34 so as to extend along the traveling paths of the traveling carriages 50. This configuration prevents troubles such as dropping of the traveling carriages 50 from the assembling stand 34, thereby improving workability of the erecting process, which enhances the safety of the transformer transporting/assembling method.

Other Embodiments

The embodiments described above are merely given as examples, and it should be understood that the present invention cited in claims is not limited thereto. Further, the configurations of respective components of the present invention are not limited to the above embodiments but may be variously changed within the technical scope of the claims.

For example, the erecting process can be performed even in a state where the erection tank 10 is disposed such that the longitudinal direction thereof is perpendicular to the extending direction of the first beams 33*a* and the second beams 33*b*. Further, the pulleys 42 and chain blocks 41 may be employed in the example shown in FIGS. 9 and 10 so as to be used as an auxiliary means of the hoisting work of the erection tank 10. Further, the wires 43 may be replaced by other flexible members such as a rope or a chain.

Further, it is possible to utilize the first portal lifter 35*a* and the second portal lifter 35*b* for the purpose of connecting the first leg iron core tank 2*a* and the second leg iron core tank 2*b*.

Further, the previously assembled U-shaped iron core 61 may be housed in the erection tank 10 and transported to an installation site of, e.g., a transformer. Also in this case, the erecting process can be performed as in the case of the above embodiments after the erection tank 10 has been disposed on the assembling stand 34.

What is claimed is:

1. A disassembled transportation transformer transporting/assembling method in which a transformer including a U-shaped iron core formed by laminating iron plates is disassembled for transportation and reassembled after the transportation near an installation site of the transformer, the method comprising:

a transporting step of transporting the U-shaped iron core in a sideways attitude where the iron plates extend horizontally to a vicinity of the installation site;

an erecting step of erecting, after the transporting step, the U-shaped iron core together with an erection tank in a sideways attitude from a state where the iron plates extend horizontally to a state where the iron plates extends vertically to make a bottom plate of the erection tank be positioned at a bottom in a state where the U-shaped iron core is housed in the erection tank, wherein the transporting step including a step of: housing a first leg iron core, a second leg iron core, and a lower-yoke iron core which are obtained by disassembling the U-shaped iron core respectively in a first leg iron core tank, a second leg iron core tank, and a lower-yoke iron core tank each of which has an opening/closing opening portion; closing the opening portions; and transporting the first leg iron core, the second leg iron core, and the lower-yoke iron core individually in a sideways attitude, wherein the erecting step includes a step in which: a portal lifter composed of two booms, which are vertically extensible and parallel movable with a predetermined distance therebetween and between which the erection tank is disposed, and a beam horizontally connecting the two booms and vertically moved as the booms extend or contract is used; the beam supports the erection tank through a flexible member at predetermined support portions; and the beam is vertically moved by extending/contracting the booms;

after the transporting step and before the erecting step, a lower-yoke iron core transferring step of transferring the lower-yoke iron core to a lower-yoke iron core assembling tank having an opening portion;

a tank connecting step of opening the opening portions of the first leg iron core tank and the second leg iron core tank while maintaining the first leg iron core, the second leg iron core, and the lower-yoke iron core in a sideways attitude and connecting the opening portions of the first leg iron core tank, the second leg iron core tank, and the lower-yoke iron core assembling tank;

an iron core connecting step of transferring, after the tank connecting step, the lower-yoke iron core to the insides of the first leg iron core tank and the second leg iron core tank and connecting the first and second leg iron cores and lower-yoke iron core;

a lower-yoke iron core assembling tank separating step of separating, after the iron core connecting step, the lower-yoke iron core assembling tank from the first leg iron core tank and the second leg iron core tank while maintaining the connecting state between the first leg iron core tank and the second leg iron core tank; and an erection tank forming step of closing, after the lower-yoke iron core assembling tank separating step, the opening portions of the first and second leg iron core tanks generated by the separation of the lower-yoke iron core assembling tank therefrom by fitting a bottom plate thereto to form the erection tank.

2. The transformer transporting/assembling method according to claim 1, wherein the two booms are moved on two rails which extend horizontally in parallel to each other with the erection tank disposed therebetween.

3. The transformer transporting/assembling method according to claim 2, wherein the predetermined support portions of the erection tank are positioned on both sides of the erection tank, and the two portal lifters which can be moved on the two rails are disposed corresponding to the predetermined support portions at a position between which the erection tank is disposed so as to support a predetermined corresponding support portions through the flexible member by means of the beams of the two portal lifters.

4. The transformer transporting/assembling method according to claim 1, wherein the predetermined support portion is positioned at substantially a center of the longitudinal side surface of the erection tank, at which a hoisting pin is provided and a hoisting ring is provided around the hoisting pin, and the hoisting ring is supported by a flexible member and the flexible member is supported by the beam, and the erecting step hoists the hoisting ring by pulling up the flexible member to hoist up the hoisting pin to thereby erect the erection tank while rotating the erection tank about the hoisting pin.

5. The transformer transporting/assembling method according to claim 1, comprising, after the transporting step and before the erecting step, a weight adding step of adding a weight to an upper side surface of the erection tank in a sideways attitude.

6. The transformer transporting/assembling method according to claim 1, wherein the erection tank has a connection seat and a traveling carriage connected to the connection seat by a pin on the bottom plate thereof, and the erecting step erects the erection tank while allowing the traveling carriage to travel, with the connection seat as a supporting point, on an assembling stand on which the erection tank is disposed.

7. The transformer transporting/assembling method according to claim 6, wherein a traveling guide is provided on the assembling stand along a traveling path of the traveling carriage, and the erecting step moves the traveling carriage along the traveling guide.

8. The disassembled transportation transformer transporting/assembling method according to claim 1, wherein the two booms are extended/contracted so that the booms have the same length.

* * * * *